US010996630B2

(12) United States Patent
Vuille

(10) Patent No.: US 10,996,630 B2
(45) Date of Patent: May 4, 2021

(54) DIAL APPLIQUE FOR A TIMEPIECE

(71) Applicant: The Swatch Group Research and Development Ltd, Marin (CH)

(72) Inventor: Pierry Vuille, Les Emibois (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/384,653

(22) Filed: Dec. 20, 2016

(65) Prior Publication Data

US 2017/0176944 A1 Jun. 22, 2017

(30) Foreign Application Priority Data

Dec. 21, 2015 (EP) ..... 15201680

(51) Int. Cl.
*G04B 19/10* (2006.01)

(52) U.S. Cl.
CPC ..... *G04B 19/103* (2013.01)

(58) Field of Classification Search
CPC .... G04B 19/10; G04B 19/103; G04B 19/106; G04B 19/14; G04B 47/042; G09F 7/06; F16B 19/04; F16B 19/06; G01N 21/956; G01N 21/95607
See application file for complete search history.

(56) References Cited

U.S. PATENT DOCUMENTS 646,843 A * 4/1900 Krahenbuhl ..... 368/236
1,121,641 A * 12/1914 Lounsbury ..... H05K 3/3478 220/250
1,310,523 A * 7/1919 Eberhard ..... G04B 19/14 368/236
2,606,418 A * 8/1952 Fluckiger ..... G04B 19/103 368/232
3,352,102 A * 11/1967 Schneider ..... G04B 23/02 368/315
3,433,013 A * 3/1969 Kohli ..... G04B 19/103 368/232

(Continued)

FOREIGN PATENT DOCUMENTS

AT 186575 B * 8/1956 ..... G04B 19/103
CH 74040 1/1917

(Continued)

OTHER PUBLICATIONS

Stern, Freres, AT 186575 English Translation , originally published Aug. 25, 1956, machine translation from Espacenet, full document.*

(Continued)

*Primary Examiner* — Daniel P Wicklund
(74) *Attorney, Agent, or Firm* — Oblon, McClelland, Maier & Neustadt, L.L.P.

(57) ABSTRACT

An applique is intended to be affixed to a timepiece dial, and includes at least one foot portion having a first end attached to the applique and a second, free end, the foot portion being arranged to be capable of insertion into a hole provided in the dial. The foot portion includes, on the side of the free end thereof, a plastically deformable area arranged to form, after deformation, once the foot portion is inserted into the hole in the dial, at least one locking area of the foot portion on the dial.

3 Claims, 2 Drawing Sheets

(56) References Cited

U.S. PATENT DOCUMENTS

| | | | | | |
|---|---|---|---|---|---|
| 4,711,586 | A * | 12/1987 | Kizawa | G04B 19/06 | 368/228 |
| 5,912,064 | A * | 6/1999 | Azuma | G04B 19/12 | 136/251 |
| 2009/0080294 | A1 * | 3/2009 | Arita | G04B 19/065 | 368/232 |
| 2011/0063606 | A1 * | 3/2011 | Babiarz | G01N 21/95 | 356/237.1 |
| 2011/0236580 | A1 * | 9/2011 | Winkler | G04B 19/10 | 427/282 |

FOREIGN PATENT DOCUMENTS

| | | | | | |
|---|---|---|---|---|---|
| CH | 318498 | | | 1/1957 | |
| CH | 564220 | | | 7/1975 | |
| CN | 204128554 | U | * | 1/2015 | |
| FR | 940815 | A | * | 12/1948 | F16B 19/04 |
| FR | 1078905 | A | * | 11/1954 | G04B 19/103 |
| FR | 2039288 | | | 1/1971 | |
| FR | 2117822 | A7 | * | 7/1972 | G04B 19/10 |
| JP | 58127191 | A | * | 7/1983 | G04B 19/103 |

OTHER PUBLICATIONS

Yu, Wenju, CN 204128554 English Translation, originally published Jan. 28, 2015, machine translation from Espacenet, full document.*

Garle, Kenneth John, FR 1078905 English Translation, originally published Nov. 24, 1954, machine translation from Espacenet, full document.*

Kagawa, Yasushi, JP 58127191 Enlish Translation, originally published Jul. 28, 1983, machine translation from Espacenet, full document.*

Indexor, English Translation of FR 2117822, originally published Jul. 28, 1972, retrieved from Espacenet on Mar. 28, 2019, full document (Year: 1972).*

Chambaut, Henri-Louis, English Translation of FR 940815, originally published Dec. 24, 1948, retrieved from Espacenet on Mar. 28, 2019, full document (Year: 1948).*

European Search Report dated Jun. 27, 2016 in European Application 15201680.4 filed on Dec. 21, 2015 (with English Translation of Categories of Cited Documents).

* cited by examiner

DIAL APPLIQUE FOR A TIMEPIECE

This application claims priority from European Patent application 15201680.4 of Dec. 21, 2015, the entire disclosure of which is hereby incorporated herein by reference.

FIELD OF THE INVENTION

The invention relates to the field of mechanical horology. It concerns, more particularly, an applique or applied chapter intended to be affixed to a timepiece dial, comprising at least one foot portion having a first end attached to the applique and a second, free end, the foot portion being arranged to be capable of insertion into a hole provided in the dial. The present invention also concerns a dial to which such an applique or applied chapter is affixed, and a method for securing such an applique on a dial.

BACKGROUND OF THE INVENTION

Appliques or applied chapters are the hour numerals or symbols cut out of sheet metal and then bonded or riveted to the dial. Appliques are provided with feet portions which are mounted on the dial in pre-formed drilled holes. Once in place, the foot portion is lapped and riveted, welded or glued inside the drilled hole. Riveting consists in pressing the free end of the foot portion inside the drilled hole, forcing it to enter the drilled hole to obtain a bonded joint. Riveting requires the application of a certain amount of force on the foot portion in order to deform the material, so this technique cannot be used for fragile dials. Further, riveting requires the application of an axial riveting force which tends to push the applique out of the dial.

To affix appliques by welding requires the selection of suitable materials, which limits the possible materials that can be used to make the appliques and the dial. For example, it is not possible to weld gold appliques onto a ceramic dial.

Moreover, if the assembly is unsatisfactory, it is not then possible, when the appliques are affixed by welding or adhesive bonding, to remove improperly positioned appliques or to make adjustments without damaging the dial.

Finally, known techniques for assembling appliques on a dial, such as riveting, welding or adhesive bonding, all have the drawback of not allowing inspection of the hold of the appliques on all the assembled pieces. Indeed, once the applique is assembled to the dial, the quality of its fastening cannot be reliably tested in a non-destructive manner. Quality control cannot therefore be applied to the entire product. Further, it is not possible to make an automated visual inspection simply by taking a photograph of the exterior of the assembly. Indeed, the deformations of the foot portion obtained by riveting are too different from each other, making automated interpretation of the results very complex.

SUMMARY OF THE INVENTION

It is a particular object of the invention to overcome the various drawbacks of known techniques for assembling appliques or applied chapters on a dial.

More precisely, it is an object of the invention to provide an applique or applied chapter permitting simple assembly on the dial while ensuring an excellent hold.

It is another object of the invention to provide an applique or applied chapter allowing for an automated inspection of the quality of the assembly by non-destructive visual means and on all the assembled pieces.

It is another object of the invention to provide an applique or applied chapter permitting reversible assembly on the dial, allowing the applique to be changed without damaging the dial.

It is another object of the invention to provide an applique that removes any constraints in the choice of materials for the dial and for the applique.

It is another object of the invention to provide a robust and stable method for affixing an applique to a dial.

To this end, the present invention concerns an applique intended to be affixed to a timepiece dial, comprising at least one foot portion having a first end attached to the applique and a second, free end, the foot portion being arranged to be capable of insertion into a hole provided in the dial.

According to the invention, the foot portion of the applique comprises, on the free end side thereof, a plastically deformable area arranged to form, after deformation, once the foot portion is inserted into the hole in the dial, at least one locking area of the foot portion on the dial.

The present invention also concerns a timepiece dial comprising at least one hole and at least one applique or applied chapter affixed to said dial, said applique comprising at least one foot portion having a first end attached to the applique and a second, free end, the foot portion being inserted into said hole. Said foot portion comprises, on the free end side thereof, at least one locking area of the foot portion on the dial, said locking area having been obtained by plastic deformation of a plastically deformable area provided on the free end side of the foot portion, once the foot portion is inserted into the hole in the dial.

The present invention also concerns a method for affixing an applique or applied chapter to a timepiece dial, said method comprising the steps of:

a) preparing an applique comprising at least one foot portion having a first end attached to the applique and a second, free end, the foot portion being arranged to be capable of insertion into a hole provided in the dial, said foot portion comprising, on the free end side thereof, a plastically deformable area,
b) inserting the foot portion of the applique into the hole in the dial,
c) deforming the plastically deformable area of the foot portion to form at least one locking area of the foot portion on the dial.

The invention makes it possible to obtain secure, reversible fastening of an applique to a dial with no constraints as to the choice of materials and allowing an automated inspection to be made of the quality of the fastening of the applique to the dial by visual means which are preferably non-destructive.

BRIEF DESCRIPTION OF THE DRAWINGS

Other features and advantages of the invention will appear more clearly upon reading the following description of several embodiments of the invention, given simply by way of illustrative and non-limiting examples, and the annexed Figures, among which.

DETAILED DESCRIPTION OF A PREFERRED EMBODIMENT

Figure 1:
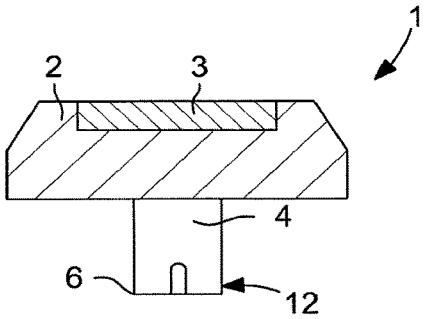
FIG. 1 represents a cross-sectional view of a first variant of an applique according to the invention.

Referring to FIG. 1, there is represented an applique 1 intended to be affixed to a timepiece dial. In a conventional manner, applique 1 comprises a head 2 on which a symbol 3 is formed, such as a numeral for indicating the hour, or any other index. The head can form the actual symbol. The head may have various shapes and various dimensions, depending on the symbol to be affixed to the dial. Applique 1 also comprises at least one foot portion 4 having a first end attached to head 2 of applique 1, and a second, free end 6. As represented, for example in FIG. 2*a*, foot portion 4 is arranged and sized to be capable of insertion into a drilled bore or hole 8, preferably a through hole, provided in dial 10 for this purpose. The number of feet portions per applique may vary, essentially according to the dimensions and shape of the applique. Foot portion 4 may preferably have a circular cross-section, but any other suitable shape may be envisaged, hole 8 then having a cross-section of complementary shape.

According to the invention, foot portion 4 comprises, on the side of its free end 6, a plastically deformable area 12 arranged to form, after deformation, once foot portion 4 is inserted into hole 8 in dial 10, at least one locking area 14 of foot portion 4 on dial 10. In the present description, the expression "on the free end side" means closer to the free end than to the joined end. Plastically deformable area 12 is arranged such that the locking area 14 obtained has contours defining a substantially elongated shape, perfectly distinct from the, for example circular, shape of free end 6 of the foot portion prior to deformation. This substantially elongated shape is reproducible and can be clearly identified by a simple, preferably non-destructive, visual inspection, such as a photograph, of the substantially elongated shape of locking area 14. Thus, the visual inspection can be automated and performed on all the assembled pieces, without having to destroy the pieces formed.

Advantageously, locking area 14 can be covered with a permanent means 26 of fastening to the dial, such as an adhesive, a melted metal, a braze or any other equivalent means. This reinforces the fastening of the applique to the dial but also fixes the position of locking area 14. Where a visual inspection is performed, said permanent means of fastening to the dial is deposited after said visual inspection.

According to the variants represented in FIGS. 2 to 6, foot portion 4 of applique 1 has a height greater than the height of hole 8 in dial 10 so that a part of foot portion 4 ending in free end 6 projects from hole 8, the plastically deformable area 12 being provided on said part of the foot portion intended to project from hole 8. Thus, locking area 14 is formed on said part of the foot portion projecting from hole 8 so as to form a sufficiently large stop surface against the lower face of dial 10 to ensure the fastening of the applique and preventing any removal of foot portion 4 from hole 10. The height of foot portion 4 is the distance separating the first end thereof attached to the applique from the second, free end 6. All the heights used in the present description are distances taken parallel to the height of foot portion 4.

Figure 2A:
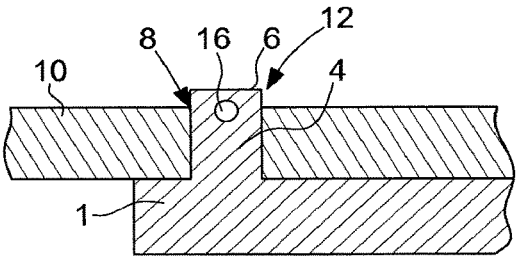
FIGS. 2*a*, 2*b* and 2*c* are cross-sectional views of a second applique variant assembled on the dial, before and after deformation.
Figure 2B:
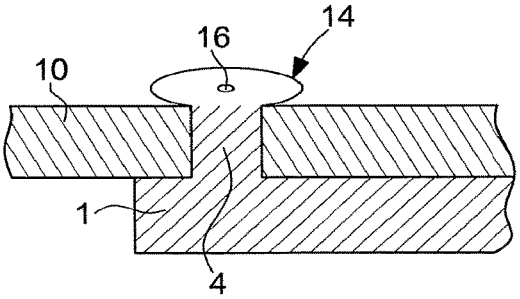
Figure 2C:
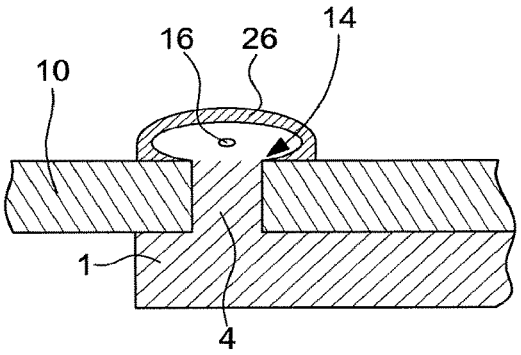

Referring to FIGS. 2*a*, 2*b* and 2*c* representing the first applique variant, the plastically deformable area 12 represented in FIG. 2*a* comprises at least one hollow 16 made in foot portion 4 on the side of free end 6 intended, in this variant, to project from hole 8 provided in dial 10.

It is clear that the number, shape and position of hollows 16 can be adapted to optimise the plastic deformation of plastically deformable area 12 of foot portion 4.

Once foot portion 4 is inserted into hole 8 in dial 10, plastically deformable area 12 projecting from hole 8 is deformed to form a locking area 14 of foot portion 4 on dial 10, as shown in FIG. 2*b*. The locking area 14 obtained has a substantially elongated shape, perfectly distinct from the, for example circular, shape of free end 6 of the foot portion prior to deformation. This substantially elongated shape is reproducible and can be clearly identified by a simple, preferably non-destructive, visual inspection, such as a photograph, of the substantially elongated shape of locking area 14. As shown in FIG. 2*c*, locking area 14 is covered with a permanent means 16 of fastening to the dial, such as adhesive, allowing said locking area 14 to be secured to the dial. Permanent fastening means 26 is deposited once the visual inspection has been carried out.

Figure 3A:
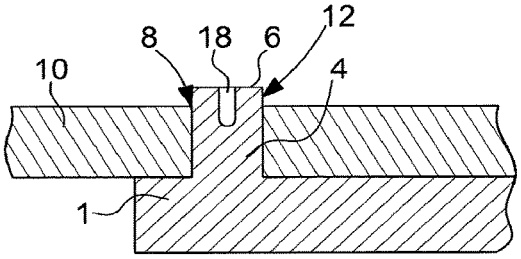
FIGS. 3*a* and 3*b* are cross-sectional views of a first embodiment of the assembly of the first applique variant according to FIG. 1 assembled on the dial, before and after deformation.
Figure 3B:
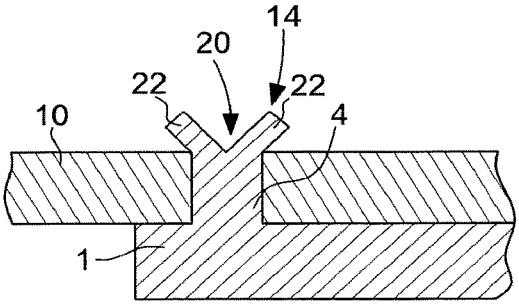
Figure 4A:
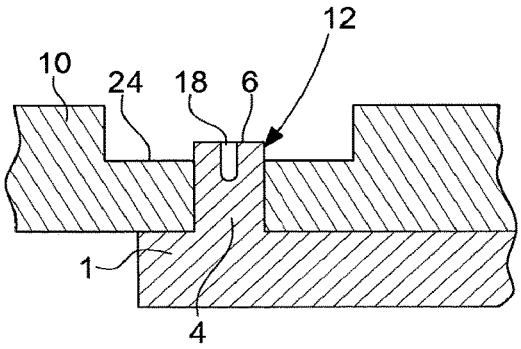
FIGS. 4*a* and 4*b* are cross-sectional views of a second embodiment of the assembly of the first applique variant according to FIG. 1 assembled on the dial, before and after deformation.
Figure 4B:
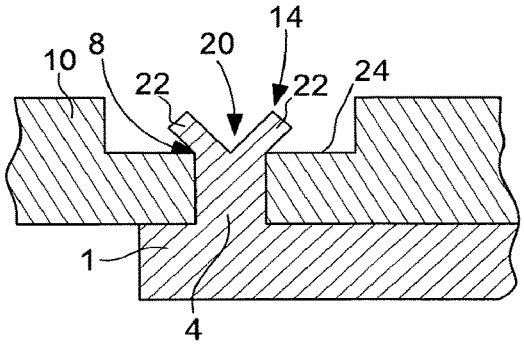
Figure 5:
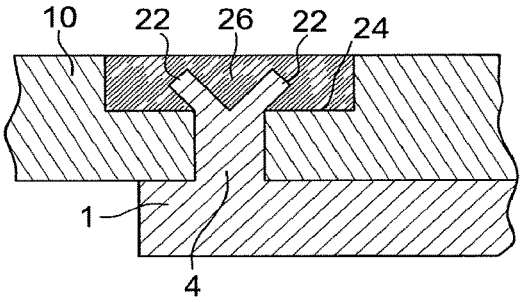
FIG. 5 is a cross-sectional view of a third embodiment of the assembly of the first applique variant according to FIG. 1 assembled on the dial, after deformation.
Figure 6A:
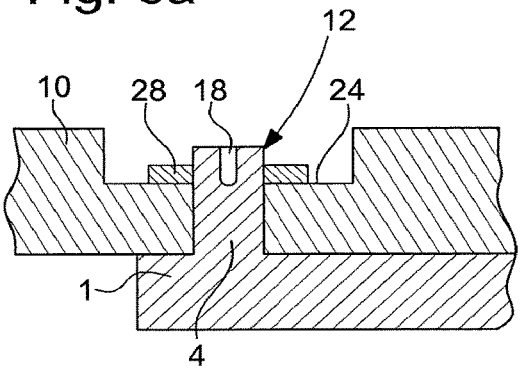
FIGS. 6*a* and 6*b* are cross-sectional views of a fourth embodiment of the assembly of the first applique variant according to FIG. 1 assembled on the dial, before and after deformation.

Referring to FIGS. 3*a* to 6*b* representing a second applique variant, plastically deformable area 12 comprises an incipient crack 18 provided on free end 6 of foot portion 4, i.e. at the surface of free end 6 forming the base of foot portion 4, as represented in FIGS. 3*a*, 4*a* and 6*a*.4 Incipient crack 18 is intended to form, after deformation of the part of foot portion 4 projecting from hole 8, once foot portion 4 is inserted into hole 8 in dial 10, at least one slot 20 starting at the free end 6 of foot portion 4, i.e. at the base of foot portion 4, to create at least two lugs 22 separated by said slot 20. Said lugs 22 are folded down onto the dial to advantageously form locking areas 14 of foot portion 4 on dial 10, as represented by FIGS. 3*b*, 4*b*, 5 and 6*b*. The number of slots and lugs may vary to form the optimum number of locking areas.

Preferably, slot 20 has a height such that, depending on the type of material used, the part of foot portion 4 inserted into hole 8 does not exhibit a crack upon deformation. Preferably, the ratio of the height underneath slot 20 (between the end attached to the applique and the base of slot 20) to the height of hole 8 in dial 10 is preferably less than 1.

The two lugs 22 separated by slot 20 and folded down onto the dial to form locking areas 14 form a contour of substantially elongated shape, perfectly distinct from the, preferably circular, shape of free end 6 of the foot portion prior to deformation. This substantially elongated shape is reproducible and can be clearly identified by a simple, preferably non-destructive, visual inspection, such as a photograph, of the substantially elongated shape of lugs 22 separated by slot 20. Thus, the visual inspection can be automated and performed on all the assembled pieces.

In the first embodiment represented in FIGS. 2*a*, 2*b*, 3*a* and 3*b*, dial 10 is planar so that the height of hole 8 is equal to the height of dial 10. The locking area 14 thus projects from the overall surface of dial 10.

In a second embodiment represented in FIGS. 4*a*, 4*b*, 5 and 6*a*, 6*b*, dial 10 comprises a recess 24 inside which through hole 8 is formed, and the height of hole 8 is equal to the height of the dial under recess 24. Thus, locking area 14 is embedded in dial 10 and does not project from the overall surface of dial 10.

In a third embodiment represented in FIG. 5, derived from the second embodiment, recess 24 is filled with a permanent means 26 of fastening to the dial, such as adhesive, to cover the part of foot portion 4 projecting from hole 8. This variant reinforces the assembly. If the assembly is checked by visual means, the adhesive will evidently by deposited after said inspection, once the assembly has been validated. The addition of a permanent fastening means also allows the position of locking area 14 to be fixed by filling the space formed between lugs 22.

Figure 6B:
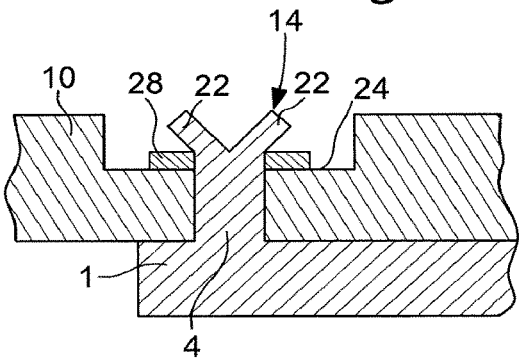

In a fourth embodiment represented in FIGS. 6*a* and 6*b*, derived from the second embodiment, a spacer 28 is provided, placed between dial 10 and locking area 14 of foot portion 4 on dial 10. Spacer 28 is inserted between foot portion 4 and dial 10. More specifically, it is disposed around the part of foot portion 4 projecting from hole 8 prior to the deformation of elastically deformable area 12. Spacer 28 may be made of metal or plastic and limits the local pressure applied by locking areas 14. This variant is particularly advantageous when the dial is made of a fragile material. Spacer 28 may also be associated with an anti-rotation part (grooved washer for example), which is particularly useful when the applique has only one foot portion.

Figure 7:
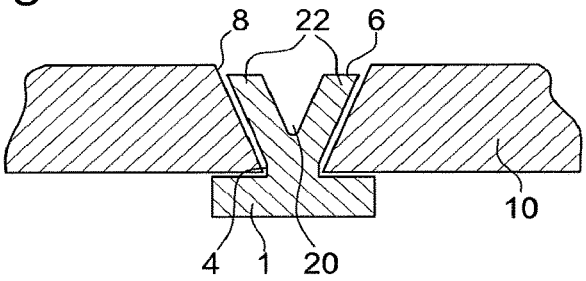
FIG. 7 is a cross-sectional view of a fifth embodiment of the assembly of the first applique variant according to FIG. 1 assembled on the dial, after deformation.

According to a fifth embodiment represented in FIG. 7, foot portion 4 has a height lower than or equal to the height of hole 8. Hole 8 has an area of conical cross-section whose dimensions are greater than the dimensions of the foot portion 4 prior to the deformation of plastically deformable area 12, to allow insertion of the foot portion into hole 8 prior to deformation. Further, the dimensions of the area of conical cross-section are chosen such that locking area 14 abuts against said area of conical cross-section. More specifically, as represented in FIG. 7, lugs 22 form an inverted cone which is inscribed within the area of conical cross-section of hole 8 such that said lugs 22 abut against the walls of hole 8 preventing any removal of foot portion 4 from hole 10. It is evident that this variant can be combined with the embodiment with the hole inside a recess, and with the use of permanent means of fastening to the dial to cover locking area 14 and fill at least hole 8.

The present invention also concerns a method for affixing an applique or applied chapter 1 to a timepiece dial 10, said method comprising the steps of:

a) preparing an applique or applied chapter 1 comprising at least one foot portion 4 having a first end attached to the applique and a second, free end 6, foot portion 4 being arranged to be capable of insertion into hole 8 in dial 10, said foot portion 4 comprising, on the side of free end 6, a plastically deformable area 12, b) inserting foot portion 4 of applique 1 into hole 8 of dial 10, c) deforming plastically deformable area 12 of foot portion 4 to form at least one locking area 14 of foot portion 4 on dial 10.

When foot portion 4 has a height greater than the height of hole 8, foot portion 4 is inserted into said hole 8 so that plastically deformable 12 projects from hole 8 of dial 10.

Advantageously, the method comprises, after step c), a step d) of inspecting the quality of the fastening of the applique to the dial by visual means. These visual means are preferably non-destructive. They may comprise, for example, a camera for taking a photograph from underneath the dial, after assembly of the applique, means for analysing the photograph obtained and means for validating the quality of the assembly, particularly as a function of the shape of the locking area of the foot portion on the dial. Obtention of an elongated shape observing pre-selected criteria will make it possible to validate the quality of the assembly. Otherwise, the free end of the foot portion can be deformed again to permit adjustment or to remove an improperly positioned applique, without having to ruin the dial. The visual inspection method is simple and can be automated to be applied to all the pieces produced.

Advantageously, the method may comprise a step e) of covering locking area 14 by a permanent means 26 of fastening to the dial, such as adhesive, allowing the applique to be secured to the dial, step e) being performed after step c), and after step d) in the event that visual inspection step d) is performed.

In the embodiment wherein dial 10 comprises a recess 24 inside which hole 8 is formed, the height of hole 8 being equal to the height of the dial underneath recess 24, the permanent means 26 of fastening to the dial is deposited on the locking area by filling recess 24, with recess 24 advantageously allowing inspection of the filling.

In the present invention, the plastically deformable area provided at the free end side of the applique foot portion allows the applique to be assembled on the dial without requiring the application of excessive force. The dial is therefore protected.

Further, the locking area formed ensures improved hold of the applique by bringing the applique closer to the dial.

The fastening method according to the invention makes it possible to obtain a fastening with a greater pull-off force than that obtained with a method of fastening by welding. This method of the invention is also more stable than a method of fastening simply by welding or by adhesive bonding.

Further, the method of the invention provides a reversible assembly of the applique allowing the latter to be changed without damaging the dial. It also allows appliques to be used with no constraints as to the choice of materials.

What is claimed is:

1. An applique intended to be affixed to a timepiece dial, comprising:

at least one foot portion having a first end attached to the applique and a second, free end, the foot portion being arranged to be insertable into a hole provided in the dial, wherein said foot portion comprises, at the free end thereof, at least one locking area of the foot portion on the dial, said locking area having been obtained by deformation of a plastically deformable area provided at the free end of the foot portion, wherein the plastically deformable area comprises at least one enclosed hollow space formed inside the free end of the foot portion, and wherein the locking area is covered with a permanent means of fastening to the dial.

2. The applique according to claim 1, wherein the foot portion has a height arranged to be greater than the height of the hole, the plastically deformable area being provided on the part of the foot portion intended to project from the hole.

3. The applique according to claim 1, wherein the permanent means of fastening is an adhesive.

* * * * *